US005715552A

United States Patent [19]

DeAth

[11] Patent Number: 5,715,552

[45] Date of Patent: Feb. 10, 1998

[54] HAMMOCK WITH COLLAPSIBLE SPREADER BARS AND SHELTERING ENCLOSURE

[76] Inventor: S. Sam DeAth, 414 Stone Rd., Unit 59, Guelph, Ontario, Canada, N1G 3E1

[21] Appl. No.: 752,103

[22] Filed: Nov. 20, 1996

Related U.S. Application Data

[62] Division of Ser. No. 467,633, Jun. 6, 1995, Pat. No. 5,655,235.

[51] Int. Cl.[6] ..... A45F 3/22

[52] U.S. Cl. ..... 5/123; 5/121; 135/96; 135/117

[58] Field of Search ..... 5/121, 128, 120, 5/122, 123; 135/117, 90, 96

[56] References Cited

U.S. PATENT DOCUMENTS

| | | | |
|---|---|---|---|
| 221,754 | 11/1879 | Travers | 5/123 |
| 312,988 | 2/1885 | Ewing | 5/123 |
| 384,728 | 6/1888 | Thomas | 5/123 |
| 483,930 | 10/1892 | Knight | 5/123 |
| 552,229 | 12/1895 | Bidwell | 5/123 |
| 560,285 | 5/1896 | Shetterly | 5/123 |
| 1,917,518 | 7/1933 | Goudie | 11/120 |
| 2,062,069 | 11/1936 | Powers | 5/123 |
| 2,375,792 | 5/1945 | Kearny | 5/121 |
| 2,745,115 | 5/1956 | Reiss | 5/122 |
| 3,837,019 | 9/1974 | Hoff | 5/120 |
| 4,001,902 | 1/1977 | Hall et al. | 5/121 |
| 4,071,917 | 2/1978 | Mojica | 5/128 |
| 4,471,794 | 9/1984 | Kirkham, Jr. | 5/120 |
| 4,542,057 | 9/1985 | Breitscheidel et al. | 5/120 |
| 4,686,720 | 8/1987 | Newell | 5/121 |
| 4,800,601 | 1/1989 | De Caro | 5/123 |
| 4,862,906 | 9/1989 | Jordon | 5/120 |
| 5,072,465 | 12/1991 | Lyons, Jr. | 5/121 |
| 5,113,537 | 5/1992 | Turk | 5/121 |
| 5,240,021 | 8/1993 | Snodgrass | 135/96 |
| 5,293,657 | 3/1994 | De Ath | 5/127 |

*Primary Examiner*—Alexander Grosz
*Attorney, Agent, or Firm*—Timothy J. Sinnott; Bereskin & Parr

[57] ABSTRACT

A hammock comprises a hammock body, suspension belts or the like for suspending the hammock between two load bearing members, and a header and suspension cord assembly at each end of the hammock which spreads the weight of a load laterally across the width of the load. This assembly includes a reinforced header located at the head end and having a laterally extending row of apertures, a spreader bar dimensioned to fit in a sleeve in each header, and a suspension cord designed to couple the suspension belt to the row of apertures in the header. The hammock is enclosed by an enclosure which is suspended above the hammock body by a spinal cord. The enclosure creates a rain and insect free space for the user. The enclosure comprises an enclosure body dimensioned to enclose the hammock body and thereby provide a space for a user, wherein the enclosure body comprises a sheet of water resistant material which when unfolded comprises a generally rectangular top portion dimensioned to enclose the top laying surface of the hammock body and a bottom portion shaped to cover the bottom surface of the hammock body, closeable access means for providing access to the space, and enclosure suspension means for suspending the enclosure body above the laying surface of the hammocks body, thereby creating an enclosed space for the user which is protected from insects and rain. The enclosure suspension means comprises a spinal cord dimensioned to extend underneath a top portion of the enclosure body along the longitudinal axis thereof, the spinal cord having a foot end which is releasably coupled to a weight distribution means, and a head end which is releasably tensionable around a load bearing member.

15 Claims, 6 Drawing Sheets

HAMMOCK WITH COLLAPSIBLE SPREADER BARS AND SHELTERING ENCLOSURE

This is a division of application Ser. No. 08/467,633 filed on Jun. 6, 1995 now U.S. Pat. No. 5,655,235. This invention relates to hammocks, particularly those having spreader bars.

FIELD OF THE INVENTION

The use and enjoyment of a hammock depends upon several factors, including location and design. Users appreciate hammocks which can be quickly and easily set up in a variety of convenient locations. The applicant's previous invention, now the subject of U.S. Pat. No. 5,293,657, is a suspension system, utilizing pairs of gripping and spanning belts, which enables a hammock to be suspended with ease in a variety of conventional and non-conventional locations.

The subject invention now addresses a number of hammock design concerns. Does the hammock give the user the impression that he is encased in a cocoon? Can the hammock be easily stored in the winter? Can the user pack the hammock with ease to take along on a camping outing? Is the user vulnerable to insects such as mosquitoes and black flies or defenceless against the elements, particularly rain?

Hammocks typically either come with built in spreader bars or no spreader bars at all. As a result, the user has had to choose between a large bulky hammock that is comfortable to rest in but cumbersome to carry, or a small compact and portable hammock that envelops the user in use. Prior art hammocks also do not usually deal with the annoyance of insects and rain encountered when using a hammock while camping.

Attempts have been made in the past to introduce a better hammock. U.S. Pat. No. 4,862,906, dated Sep. 5, 1989, granted to Jordon for a "Multiform Convertible Tent and Hammock," discloses a tent-hammock combination, in which up to five separate structures may be formed. Form one is a hammock and form two is a hanging pup tent with the hammock as the base. Both of these structures have spreader bars at the end of the hammock material that consist of three hollow interconnectable tubes at the ends of which are loops that are meant to be points of anchoring for spanning ropes. This hammock/tent is believed to have three disadvantages. First, the hammock is suspended from the bars inserted in the end sleeves. This design places the force of the load on the bars themselves, hence necessitating suspension bars of sufficient tensile strength to bear potential loads. Second, with the Jordan device the spanning ropes attach directly to loops at the ends of the spreader bars, thereby placing the load bearing stress on only two points. Third, the plethora of parts that comprise the Jordan device make it necessary to sort out numerous components merely to set up a basic hammock structure.

U.S. Pat. No. 4,471,794, dated Sep. 18, 1984, granted to Kirkham for a "Hammock Tent System", discloses a multiform tent structure that can be adapted as a hammock. It consists of a rectangular sheet of flexible material and a support pole made from a plurality of interlocking parts. In its hammock configuration, Kirkham's structure has a number of shortcomings. First, the load bearing poles at the ends of the hammock are not spreader bars and accordingly do not keep the hammock material spread open. Second, in the Kirkham invention, the load is transferred to the end sides of the hammock while the load is centered in the middle of the hammock. Hence the load is poorly borne placing the greatest stress on the unsupported center of the load bearing poles. Third, the strap configuration around the load bearing poles tend to cause the material to slip and excessively bunch in the center, thereby pinching the upper and lower torso of the user.

U.S. Pat. No. 1,917,518, dated Jul. 11, 1893, granted to C. R. Goudie for a "Canvas Hammock", discloses a canvas hammock that has one piece notched spreader bars enclosed at the head and foot of the hammock designed to receive the supporting suspension cords. There are two disadvantages to this hammock. First, the spreader bars are one piece and hence they are not collapsible to a smaller, more portable size. Second, the spreader bars are also load bearing in that the suspension cords are affixed to them. Hence, the spreader bars perform a double duty. They keep the hammock material open and they bear the load. Further, the load is borne on only five points and it is at these points that the bars are notched to receive the suspension cords. Accordingly, this would weaken the structural integrity of the bar at the points where strength is needed the most.

U.S. Pat. No. 4,542,057, dated Sep. 17, 1985, granted to Breitscheidel et al. for a "Hammock", discloses a hammock having a mat portion and loop-shaped arrangement at the head and foot ends of the mat portion to accommodate mounting dowels. The mat portion comprising an elastic cross-linked synthetic resin foam sheet reinforced with a flat textile layer. There are two disadvantages to this hammock design. First, the hammock is suspended by support cords attached to the outer extremity of the header and footer bars of the hammock. Such a configuration makes the hammock more stable, but it transfers the load force to the center of the load bearing bars. Second, the load in the hammock would primarily bear on the center of the support bars. If these bars flex, the counter pull of the suspension cords on the extremities of these bars will place a stress on the outer edge of the fabric sleeve through which the support bars are slidably received, thereby increasing the likelihood of the fabric tearing at these stress points.

SUMMARY OF THE INVENTION

There is accordingly a need for a hammock which overcomes the disadvantages of the prior art. It is further desirable to have a hammock which is compact, easily portable, simple to assemble, comfortable to lie in without it enveloping the user, practical to store and well engineered so that the components wear evenly and with the added convenience of an integrated storm and bug fly.

The present invention is directed towards a hammock comprising a hammock body of predetermined length, width and strength suitable for holding a load having a weight within a given weight range, suspension means for suspending the hammock body between two spaced load bearing members, and weight distribution means for distributing the weight of the load laterally across the width of the hammock body. The weight distribution means comprises a reinforced header extending transversely across each end of the hammock body having attachment means for attaching the header to the suspension means, and spreading means spaced from the attachment means for laterally spreading the hammock body while under load.

The subject hammock may comprise a durable, flexible material of determinable length that is folded and stitched at each end of the hammock so as to produce a sleeve for the spreader bars and grommet surface that runs parallel to the hammock ends having a number of grommets secured therein, a pair of spreader bars of determinate length, shape and of a resilient material that are slidably received in the header sleeves, security tabs appropriately located to lock the spreader bars in once they have been inserted into the desired location, and a sufficient quantity of suspension cord to be strung through the grommets, thereby forming a means of attaching the hammock to various suspension means.

The present invention is also directed to an enclosed hammock having removable enclosure means, and to a hammock enclosure, comprising an enclosure body dimensioned to wrap around the hammock body and create an enclosed space for a user, closeable access means for providing access to the space, and a spinal cord for suspending the enclosure above the laying surface of the hammock body.

The enclosure body preferably comprises a flexible sheet of water-resistant material, and the enclosure suspension means preferably comprises a spinal cord adapted to be coupled at one end to a load bearing member and at another end to the weight distribution means of the hammock.

BRIEF DESCRIPTION OF THE DRAWINGS

The invention will now be described, by way of example only, with reference to the following drawings, in which.

DETAILED DESCRIPTION OF THE PREFERRED EMBODIMENTS

Figure 1:
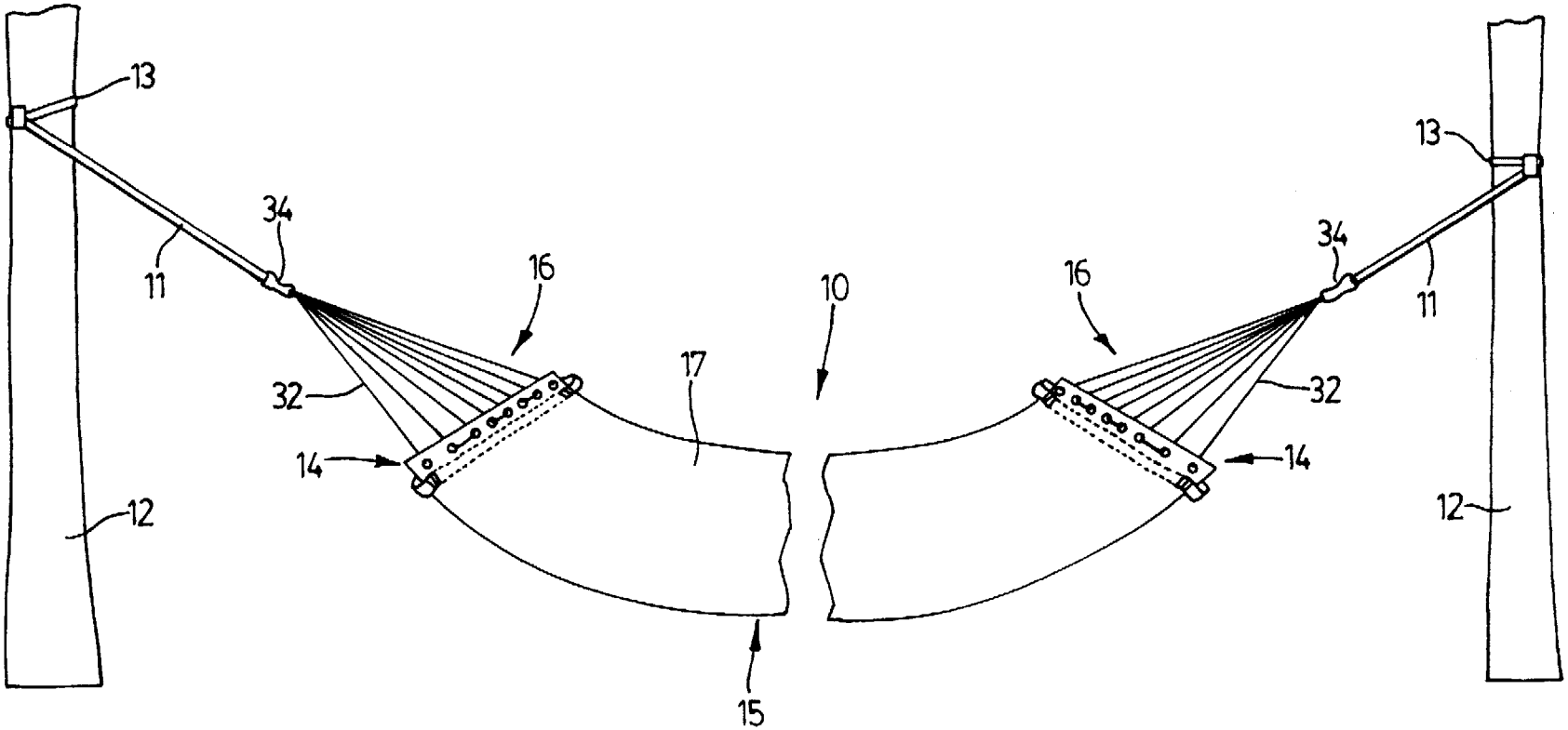
FIG. 1 is a perspective view of a preferred embodiment of a hammock shown made in accordance with the subject invention.

Referring to FIG. 1, in a preferred embodiment, the subject invention comprises hammock 10, shown suspended by spanning belts 11 coupled to load bearing members 12 by gripping belts 13, and having a swinging longitudinal axis A. Hammock 10 comprises hammock body 15 having a top laying surface 17 dimensioned to provide accommodation for one or more persons, and weight distribution means shown generally as 16 which distributes the weight of a person or other load laterally across the width of hammock body 15 along hammock transverse axis B. Weight distribution means 16 comprises a transverse header assembly 14 located at both ends of the hammock body coupled to spanning belts 11 by suspension cords 32 and snap hooks 34. Hammock body 15 may be made of canvas or other flexible materials of sufficient strength to bear potential loads and of sufficient resilience to withstand repeated use under varying weather conditions.

Figure 2:
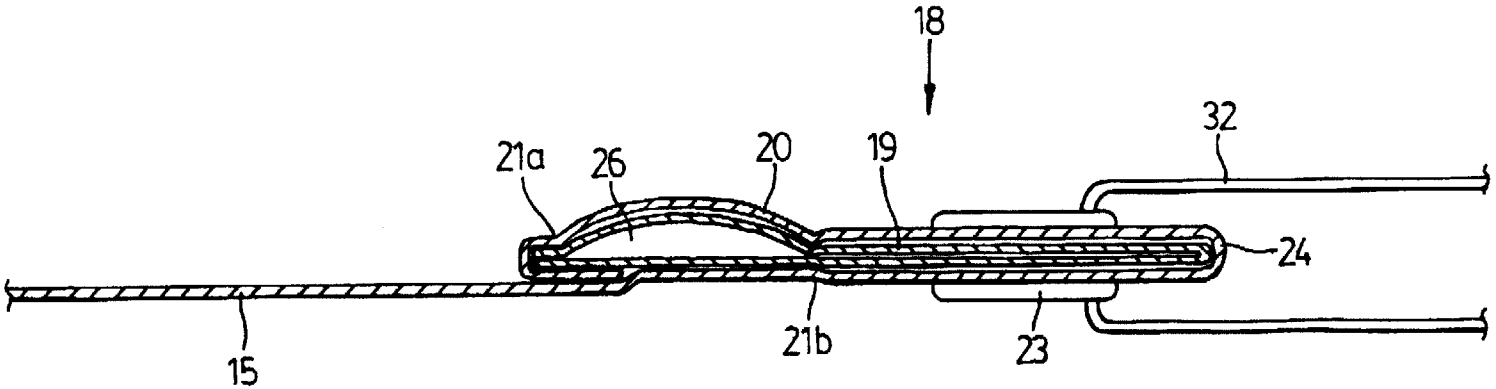
FIG. 2 is a sectional view of the header of the subject invention.

Referring now to FIG. 2, each header assembly 14 includes a reinforced header 18 comprising a folded-over strip of reinforcement material 19 sandwiched between a folded-over end portion 20 of hammock body 15. The layers 19, 20 of header 18 are stitched together via parallel lines of stitching **21*a* and 21*b*, spaced from header end edge 24. Lines of stitching 21*a*, 21*b* form a transverse sleeve 26 which extends across the width of header 18. Reinforcement strip 19 of header 18 is preferably made from p.v.c. coated synthetic scrim, such as 28** oz. Shelter-Rite™ brand scrim.

Figure 3:
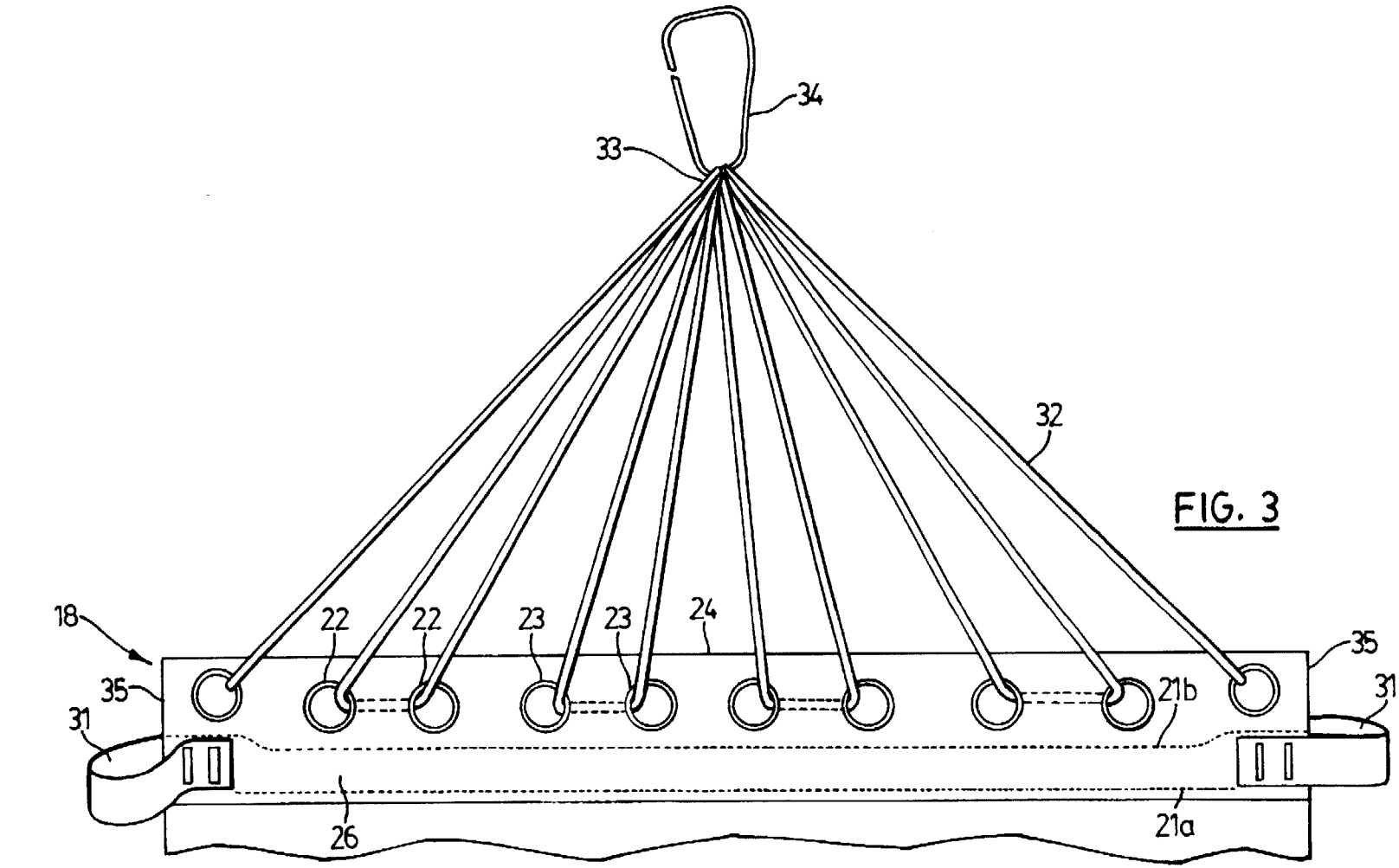
FIG. 3 and 4 are top plan views of components of the weight distribution means of the subject invention.

As shown in FIG. 3, each header 18 includes a row of apertures 22 formed by grommets 23, located between sleeve 26 and header end edge 24. Apertures 22 formed by grommets 23 are of sufficient number and location to distribute the hammock load uniformly along the length of header 18.

Suspension cord 32 is threaded through grommets 23 with sufficient slack so that the loops of suspension cord 32 can be drawn together at apex point 33 and attached to snap hook 34. Suspension cord 32 is of sufficient strength and length to couple each header 18 to one of suspension belts 11. Suspension cord 32 is preferably strung as shown in FIG. 3 so that the load in the hammock 10 can be evenly borne from grommets 23 of header 18 and transferred along to snap hook 34 and subsequently to load bearing member 12 via suspension belts 11.

Figure 4:
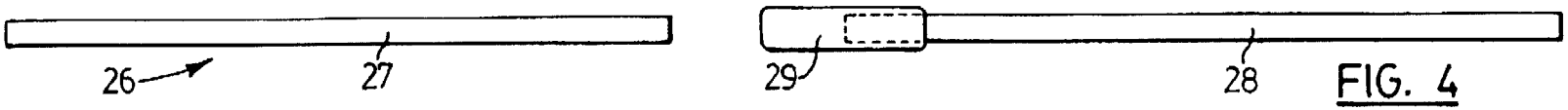

Referring now to FIG. 4, header assembly 14 also comprises a spreader bar 25 dimensioned to fit within sleeve 26 of each header 18. Spreader bar 25 preferably comprises two or more spreader bar sections 27, 28 of equal length and suitable tensile strength. Bar section 28 includes a coupler 29 extending from one end thereof having an axial aperture dimensioned to slidably receive the end of bar section 27. Spreader bars 25 are preferably made of a resilient fiberglass or like material. Once inserted into header 18, spreader bars 25 keep the hammock body 15 from curling in when under load. Flexible u-shaped security tabs 31 extending from the side edges 35 of each header 18 are shaped to be pulled over the ends of spreader bars 25 to keep them in place in sleeve 26 while hammock 10 is under load.

Figure 5:
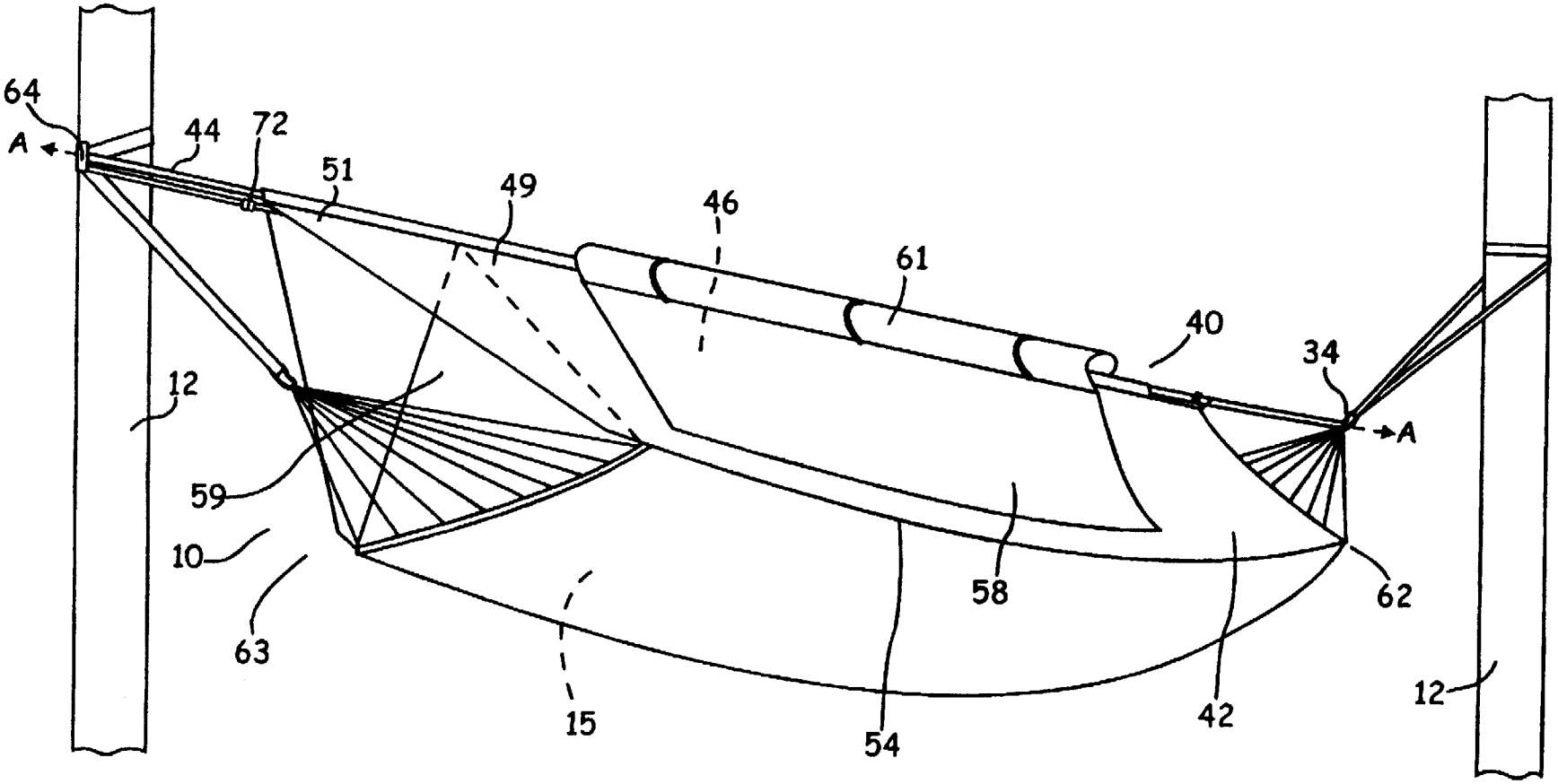
FIG. 5 is a perspective view of the subject hammock having coupled thereto the enclosure of the subject invention.

Referring now to FIG. 5, the present invention is also directed towards an enclosure shown generally as 40 for hammock 10. Enclosure 40 is designed to create an enclosed space which shelters the user of hammock 10 from insects and rain. Enclosure 40 comprises an enclosure body 42 having a top portion 49 which is suspended above hammock 10 by enclosure suspension means in the form of guy line or spinal cord 44. Enclosure body 42 is made from a flexible sheet dimensioned to envelope hammock body 15 and create enclosed space 46 between the laying surface 17 of hammock body 15 and spinal cord 44. Enclosure body 42 is preferably made of material such as nylon which is water resistant and capable of protecting the hammock occupant from flying insects.

The top portion 49 of enclosure body 42 includes an open vestibule section 51 located over the head end 63 of hammock 10, shaped to protect the head of the user from rain. Mesh window 59 separates vestibule section 51 from enclosed space 46. User access means in the form of zipper 54 extends longitudinally along enclosure body 42. Enclosure body 42 preferably also includes side ventilation means in the form of suitably positioned mesh side windows 57, 58 made of a highly permeable material. Rain flaps 60, 61 sized to cover windows 57, 58 are affixed along the upper edges thereof.

Figure 6:
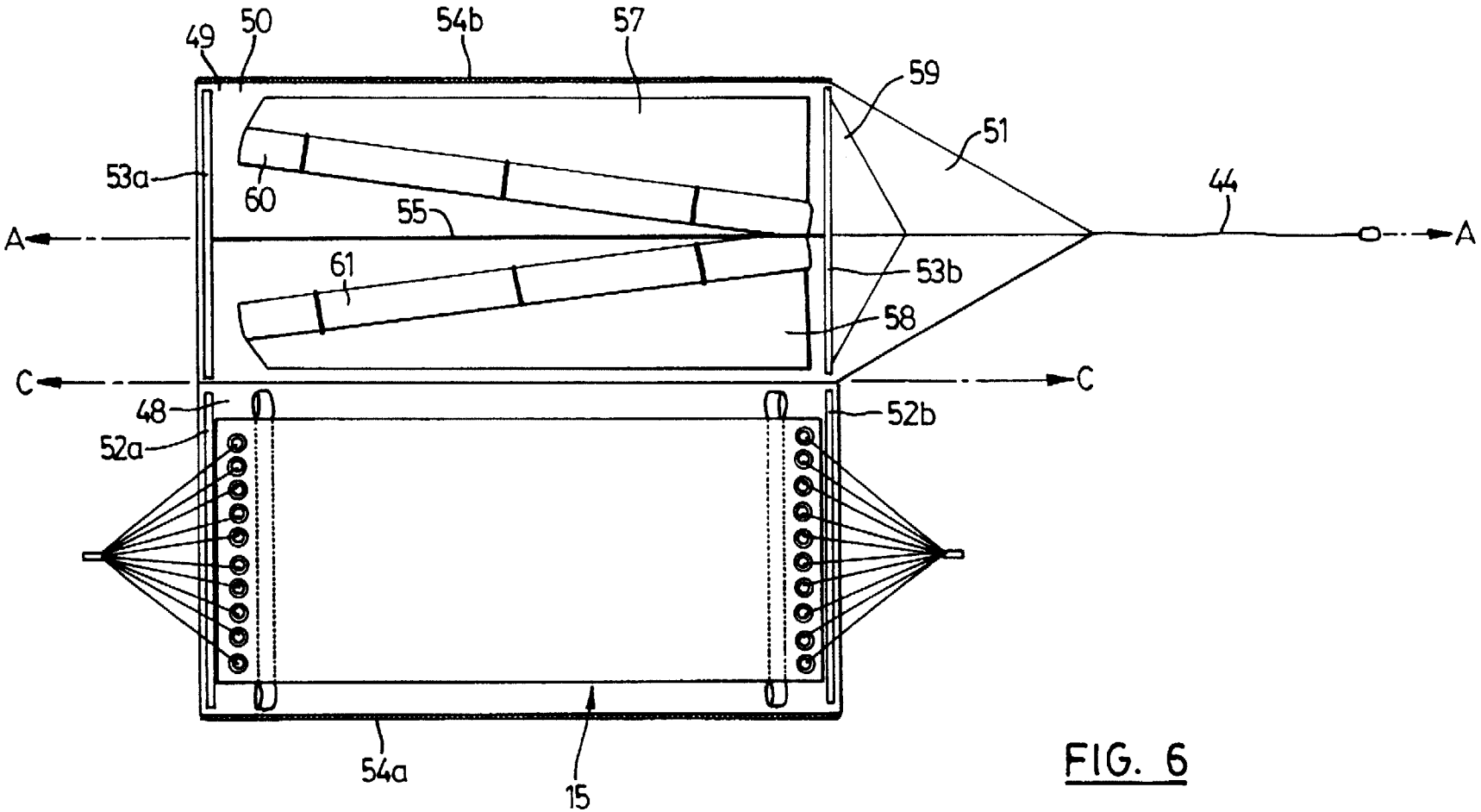
FIG. 6 is a top plan view of the enclosure of the subject invention, in its unfolded position.

Referring now to FIG. 6, enclosure body 42 in its unfolded state comprises a rectangular base portion 48 sized to cover the bottom surface of hammock body 15 and top portion 49 which acts as the sides and roof of the occupant enclosure. Top portion 49 comprises a rectangular main section 50 and a triangular vestibule section 51. Transverse closure means in the form of fastener strips 52*a*, 52*b* and 53*a*, 53*b*, which extend transversely along the sides of base portion 48 and a rectangular part 50 of top portion 49. Fastener strips 52*a*, 52*b* and 53*a*, 53*b* may take the form of VELCRO® or like fasteners consisting of mating strips of hooks and loops. Zipper portions 54*a*, 54*b* extend longitudinally along the edges of base portion 48 and top portion 49. Top portion 49 of enclosure body 42 includes a longitudinal center sheath 55 dimensioned for slidably receiving spinal cord 44.

Figure 8:
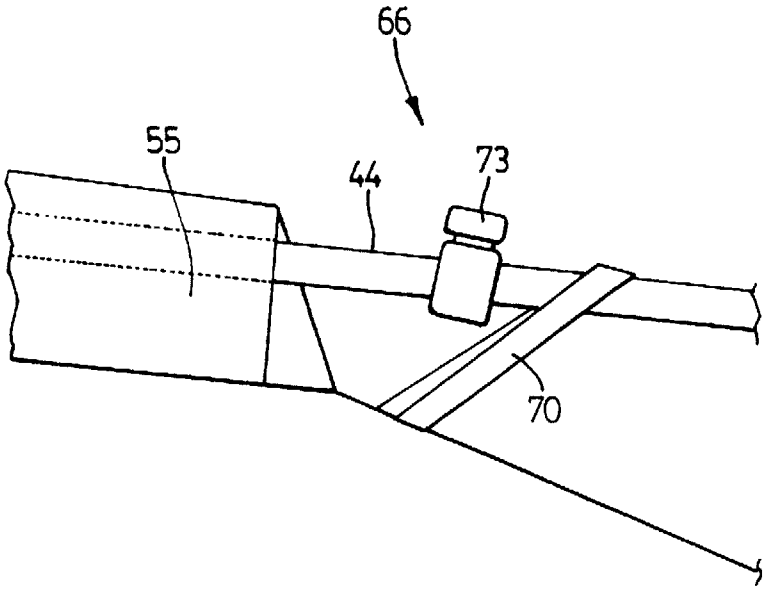
FIG. 8 is a close-up view of a portion of the foot end of the enclosure means.
Figure 7:
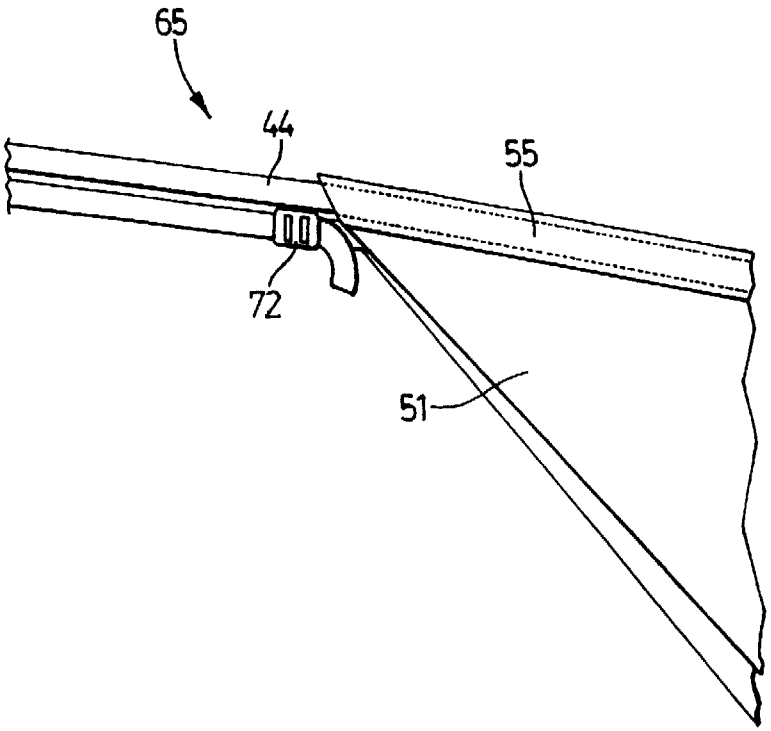
FIG. 7 is a close-up view of a portion of the end head of the enclosure of the subject invention.

Referring now to FIGS. 7 and 8, enclosure 40 also comprises securing means 65, 66 for adjustably securing each end of enclosure body 42 comprises an adjustable buckle 72 sewn to the tip of vestibule section 51 near sheath 55. Spinal cord 44 is looped around load bearing member 12 through belt loops 64 and then coupled to buckle 72. Foot end securing means 66 comprises elastic 70 sewn into the seam of roof portion 49, and barrel lock 73 slidably received on spinal cord 44. Securing means 65, 66 prevent enclosure body 42 from bunching up towards the middle of spinal cord 44 when the hammock is under load.

Referring again primarily to FIGS. 5, 7 and 8, enclosure 40 is fitted onto hammock 10 as follows. Hammock 10 is suspended between load bearing members 12 and the base portion 48 of enclosure body 42 is placed under the suspended hammock body 15. Enclosure body 42 is folded in half along longitudinal fold axis C, by overlaying the laying surface 17 of hammock body 15 with top portion 49. At this point, transverse fastener strips 52*a* and 52*b* are mated with transverse fastener strips 53*a* and 53*b*, respectively, across the lines of suspension cords 32. To create space for the user within the now sealed enclosure body, spinal cord 44 is run from the snap hook 34 at the foot end 62 of hammock 10 through elastic band 70 and sheath 55 of top portion 49 along longitudinal hammock axis A, and then through belt loops 64 around opposite load bearing member 12 and back to buckle 72 located at head end 63. Spinal cord 44 is then pulled taunt by cinching buckle 72, and barrel lock 73 is tensioned against elastic band 70, thereby taking up slack in top portion 49 and creating a protected sleeve of space for the occupant of the hammock.

In use, as hammock body 15 stretches under load, spreader bars 25 keep the hammock from lateral curling. The force of the load is distributed from apex points 33 to grommets 23 by suspension cords 32. Grommets 23 spread the load out across reinforced strip 19 of headers 18, which in turn distribute the weight of the load across hammock body 15 by stitching 21*a*, 21*b*. Enclosure body 42 suspended by spinal cord 44 provides the user with an enclosed, insect free space. Securing means 65, 66 keep the top portion 49 of enclosure body 42 from bunching up in the middle during use.

The subject invention provides a superior comfortable hammock that is highly portable, easy to erect and that also offers protection from some annoyances of nature such as rain and bugs. The subject invention also increases the life of the hammock, by reducing wear points due to improper weight distribution.

Further, in a preferred embodiment, all of the components necessary to erect the hammock can be placed in a small 19.5"×4.5" cylindrical bag that is easy to store or transport, with the total weight thereof being approximately 3.5 lbs.

It should be understood that various changes may be made to the preferred embodiment of the invention described herein, without departing from the scope of the subject invention, which is defined in the following claims.

I claim:

1. An enclosed hammock, comprising:

(a) a generally rectangular hammock body having top laying surface and a bottom surface;

(b) suspension means for suspending the hammock body between two spaced load bearing members;

(c) weight distribution means located at each end of the hammock body for distributing the weight of a load laterally across the hammock body; and (d) enclosure means for enclosing the hammock body, comprising an enclosure body dimensioned to enclose the hammock body and thereby provide a space for a user, the body having a ventilated head section and an enclosed foot section, closeable access means for providing access to the space, and enclosure suspension means for suspending the enclosure body above the laying surface of the hammock body, thereby creating an enclosed space for the user which is protected from insects and rain;

(e) wherein the enclosure suspension means comprises a spinal cord dimensioned to extend underneath a top portion of the enclosure body along the longitudinal axis thereof, the spinal cord having a foot end which is releasably coupled to the weight distribution means adjacent the foot section of the enclosure body, and a head end which is releasably tensionable around the load bearing member adjacent the head section of the enclosure body.

2. The enclosed hammock defined in claim 1, wherein the enclosure body comprises a longitudinal sheath shaped to slicably receive the spinal cord.

3. The enclosed hammock defined in claim 2, wherein the head end of the spinal cord is adapted to be coupled to a buckle extending from the enclosure body.

4. The enclosed hammock defined in claim 3, wherein the enclosure means also comprises securing means for adjustably securing the enclosure body to the spinal cord in a non-slip fashion.

5. The enclosed hammock defined in claim 4, wherein the securing means comprises an elastic band extending from one end of the enclosure body and adapted to extend around the foot end of the spinal cord and a barrel lock slidably receivable on the spinal cord adapted to be tensioned against the elastic band.

6. The enclosed hammock defined in claim 1, wherein the weight distribution means comprises a transversely extending reinforced header, spreading means for laterally spreading the hammock body while under load, and header coupling means for coupling tile header to the suspension means, and wherein the foot end of the spinal cord is releaseably coupled to the header coupling means.

7. The enclosed hammock defined in claim 6, wherein the header coupling means comprises a series of apertures extending along the edge of the header, a suspension cord adapted to be threaded through the apertures, and snap hook means for releasably hooking the suspension cord to the suspension means, and wherein the foot end of the spinal cord is releasably coupled to the snap hook means.

8. An enclosed hammock comprising:

(a) a generally rectangular hammock body having a top laying surface and a bottom surface;

(b) suspension means for suspending the hammock body between two spaced load bearing members;

(c) weight distribution means located at each end of the hammock body for distributing the weight of a load laterally across the hammock body; and (d) enclosure means for enclosing the hammock body, comprising an enclosure body dimensioned to enclose the hammock body and thereby provide a space for a user, closeable access means for providing access to the space, and enclosure suspension means for suspending the enclosure body above the laying surface of the hammock body, thereby creating an enclosed space for the user which is protected from insects and rain;

(e) wherein the enclosure body comprises a sheet of water resistant material which when unfolded comprises a generally rectangular top portion dimensioned to enclose the top laying surface of the hammock body and a bottom portion shaped to cover the bottom surface of the hammock body.

9. The enclosed hammock defined in claim 8, wherein the top portion of the sheet comprises a generally rectangular section and a triangular vestibule section extending therefrom.

10. The enclosed hammock defined in claim 9, wherein the vestibule portion includes a mesh window which is connectable to the bottom portion.

11. The enclosed hammock defined in claim 8, wherein the enclosure body also includes coupling means extending transversely along the sides of the bottom portion and the top portion for coupling the top portion to the bottom portion when the enclosure is placed around the hammock body.

12. The enclosed hammock defined in claim 11, wherein the coupling means comprises mating fastener strips.

13. The enclosed hammock defined in claim 8, wherein the enclosure body comprises mesh window sections closeable by rain flaps.

14. An enclosure for a hammock having a hammock body with a top laying surface and a bottom surface which is adapted to be suspended between two load bearing members, and which includes weight distribution means for distributing the weight of a load laterally across the hammock body, the enclosure comprising an enclosure body dimensioned to enclose the hammock body and thereby provide a space for a user, wherein the enclosure body comprises a sheet of water resistant material which when unfolded comprises a generally rectangular top portion dimensioned to enclose the top laying surface of the hammock body and a bottom portion shaped to cover the bottom surface of the hammock body, closeable access means for providing access to the space, and enclosure suspension means for suspending the enclosure body above the laying surface of the hammock body, thereby creating an enclosed space for the user which is protected from insects and rain.

15. An enclosure for a hammock having a hammock body with a top laying surface and a bottom surface which is adapted to be suspended between two load bearing members, and which includes weight distribution means for distributing the weight of a load laterally across the hammock body, the enclosure comprising an enclosure body dimensioned to enclose the hammock body and thereby provide a space for a user, closeable access means for providing access to the space, and enclosure suspension means for suspending the enclosure body above the laying surface of the hammock body, wherein the enclosure suspension means comprises a spinal cord dimensioned to extend underneath a top portion of the enclosure body along the longitudinal axis thereof, the spinal cord having a foot end which is releasably coupled to one of the weight distribution means, and a head end which is releasably tensionable around one of the load bearing members, thereby creating an enclosed space for the user which is protected from insects and rain.

* * * * *